US011536219B2

(12) United States Patent
Suzuki et al.

(10) Patent No.: US 11,536,219 B2
(45) Date of Patent: Dec. 27, 2022

(54) CYLINDER LINER AND SEALING STRUCTURE FOR CYLINDER LINER

(71) Applicant: MITSUBISHI HEAVY INDUSTRIES ENGINE & TURBOCHARGER, LTD., Sagamihara (JP)

(72) Inventors: Hajime Suzuki, Sagamihara (JP); Sota Watanabe, Sagamihara (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 17/598,063

(22) PCT Filed: Aug. 29, 2019

(86) PCT No.: PCT/JP2019/034017
§ 371 (c)(1),
(2) Date: Sep. 24, 2021

(87) PCT Pub. No.: WO2020/217560
PCT Pub. Date: Oct. 29, 2020

(65) Prior Publication Data

US 2022/0186676 A1 Jun. 16, 2022

(30) Foreign Application Priority Data

Apr. 23, 2019 (JP) ..... JP2019-081470

(51) Int. Cl.
*F02F 1/10* (2006.01)
*F02F 1/16* (2006.01)

(52) U.S. Cl.
CPC ..... *F02F 1/16* (2013.01)

(58) Field of Classification Search
CPC ..... F02F 1/16; F02F 1/163; F16J 10/04
(Continued)

(56) References Cited

U.S. PATENT DOCUMENTS 3,853,099 A * 12/1974 Feather ..... F02F 11/005 123/41.82 R
10,480,499 B2 * 11/2019 Hebrard ..... F04B 39/128
(Continued)

FOREIGN PATENT DOCUMENTS

DE 199 13 468 A1 10/2000
JP 54-150707 U 10/1979
(Continued)

OTHER PUBLICATIONS

International Preliminary Report on Patentability and English translation of the Written Opinion at the International Searching Authority dated Nov. 4, 2021 for Application No. PCT/JP2019/034017.
(Continued)

*Primary Examiner* — Long T Tran
*Assistant Examiner* — James J Kim
(74) *Attorney, Agent, or Firm* — Birch, Stewart, Kolasch & Birch, LLP

(57) ABSTRACT

A cylinder liner includes: a small diameter portion configured to form a cooling water passage between the small diameter portion and an inner peripheral surface of the cylinder block; a large diameter portion disposed adjacent to the small diameter portion in the axial direction and formed to have a larger diameter than the small diameter portion; and at least one seal groove formed on an outer peripheral surface of the large diameter portion in an annular shape along a circumferential direction. The large diameter portion includes a one-side wall portion formed between the cooling water passage and a cooling-water-passage-side seal groove which is a seal groove disposed closest to the cooling water passage in the axial direction, and an other-side wall portion disposed farther from the cooling water passage than the cooling-water-passage-side seal groove is in the axial direction. The one-side wall portion is configured to have, in at
(Continued)

least part in a circumferential direction including a thrust direction of the piston, a larger distance to the inner peripheral surface of the cylinder block than a distance from the other-side wall portion to the inner peripheral surface of the cylinder block.

9 Claims, 8 Drawing Sheets

(58) Field of Classification Search
USPC ..... 123/41.84
See application file for complete search history.

(56) References Cited

U.S. PATENT DOCUMENTS

| | | | | |
|---|---|---|---|---|
| 10,697,393 | B2 * | 6/2020 | Becker | F16J 10/04 |
| 2005/0199196 | A1 * | 9/2005 | Azevedo | F02F 1/16 123/41.84 |
| 2007/0227475 | A1 * | 10/2007 | Hiramitsu | F02F 1/16 123/193.2 |

FOREIGN PATENT DOCUMENTS

| | | | |
|---|---|---|---|
| JP | 6-63850 | U | 9/1994 |
| JP | 7-166954 | A | 6/1995 |
| JP | 2007-292062 | A | 11/2007 |
| JP | 2016-3608 | A | 1/2016 |

OTHER PUBLICATIONS

International Search Report dated Nov. 12, 2019 for Application No. PCT/JP2019/034017 with an English translation.

Suzuki, Proving Document for seeking Application of Provision of Exceptions to Lack of Novelty of Invention, Jul. 31, 2018, 6 pages, with an English translaion.

* cited by examiner

CYLINDER LINER AND SEALING STRUCTURE FOR CYLINDER LINER

TECHNICAL FIELD

The present disclosure relates to a cylinder liner that is mounted on a cylinder block of an internal combustion engine and slidably accommodates a piston along the axial direction, and to a sealing structure for the cylinder liner.

BACKGROUND

In a water-cooled engine (internal combustion engine), a cooling water passage may be formed between an inner peripheral surface of a bore of a cylinder block and an outer peripheral surface of a cylinder liner (see Patent Document 1). The cylinder liner has a seal groove formed in an annular shape along the circumferential direction. By inserting an O-ring in the seal groove, the cooling water passage is sealed to prevent the leakage of cooling water.

The cylinder liner accommodates a piston slidably along the axial direction. The piston is connected to one longitudinal end of a connecting rod via a piston pin. The other longitudinal end of the connecting rod is connected to a crankshaft. During operation of the internal combustion engine, the piston performs a reciprocating motion along the axial direction. The reciprocating motion of the piston is converted to a rotational motion of the crankshaft by the piston pin and the connecting rod.

Due to the reciprocating motion of the piston and the rotational motion of the crankshaft, the cylinder liner is subjected to a thrust force from the piston toward the outside in the radial direction. The thrust force acts in a direction (thrust direction) perpendicular to the axis of the cylinder liner and the axis of the piston pin.

CITATION LIST

Patent Literature

Patent Document 1: JPH7-166954A

SUMMARY

Problems to be Solved

The cylinder liner moves in the thrust direction for a short time due to the thrust force generated by the piston. As the cylinder liner moves in the thrust direction for a short time, the volume in the thrust direction of a portion of the cooling water passage in the vicinity of the cooling-water-passage-side seal groove decreases, and cooling water is pushed from the vicinity portion in a direction away from the seal groove. If the flow velocity of cooling water pushed from the vicinity portion is too high, a negative pressure area may be generated in the cooling water passage, and cavitation may occur. If cavitation occurs frequently in the cooling water passage, the O-ring may wear out, and cooling water may leak from the cooling water passage.

To prevent cavitation from occurring and progressing in the cooling water passage, chemicals may be added to cooling water to form a film, but this may worsen the operating cost of the internal combustion engine because of the need to add the chemicals and to manage the adding process.

Patent Document 1 merely discloses the use of plating on the cylinder liner to prevent damage to the cylinder liner due to cavitation, but does not disclose any means to prevent the occurrence of cavitation.

In view of the above, an object of at least one embodiment of the present invention is to provide a cylinder liner that can suppress the occurrence of cavitation.

Solution to the Problems (1) A cylinder liner according to at least one embodiment of the present invention is a cylinder liner mounted on a cylinder block of an internal combustion engine and slidably accommodating a piston along an axial direction. The cylinder liner comprises: a small diameter portion configured to form a cooling water passage between the small diameter portion and an inner peripheral surface of the cylinder block; a large diameter portion disposed adjacent to the small diameter portion in the axial direction and formed to have a larger diameter than the small diameter portion; and at least one seal groove formed on an outer peripheral surface of the large diameter portion in an annular shape along a circumferential direction. The large diameter portion includes a one-side wall portion formed between the cooling water passage and a cooling-water-passage-side seal groove which is a seal groove disposed closest to the cooling water passage in the axial direction, and an other-side wall portion disposed farther from the cooling water passage than the cooling-water-passage-side seal groove is in the axial direction. The one-side wall portion is configured to have, in at least part in a circumferential direction including a thrust direction of the piston, a larger distance to the inner peripheral surface of the cylinder block than a distance from the other-side wall portion to the inner peripheral surface of the cylinder block.

According to the above configuration (1), the one-side wall portion of the cylinder liner is configured to have, in at least part in the circumferential direction including the thrust direction of the piston, a larger distance to the inner peripheral surface of the cylinder block than the distance from the other-side wall portion to the inner peripheral surface of the cylinder block. In other words, a portion of the cooling water passage in the vicinity of the cooling-water-passage-side seal groove has a large volume in at least part in the circumferential direction including the thrust direction of the piston. Since the cylinder liner has a large volume in the vicinity portion to increase the volume of cooling water in the vicinity portion, the pressure applied to cooling water in the vicinity portion can be dispersed when the cylinder liner moves in the thrust direction for a short time. As a result, it is possible to suppress the increase in flow velocity of cooling water pushed from the vicinity portion. By suppressing the increase in flow velocity of cooling water pushed from the vicinity portion, the cylinder liner can suppress the occurrence of negative pressure area in the cooling water passage, and thus suppress the occurrence of cavitation.

(2) In some embodiments, in the cylinder liner described in the above (1), the one-side wall portion is configured to have, over the entire circumference in the circumferential direction, a larger distance to the inner peripheral surface of the cylinder block than a distance from the other-side wall portion to the inner peripheral surface of the cylinder block.

According to the above configuration (2), the one-side wall portion of the cylinder liner is configured to have, over the entire circumference in the circumferential direction, a larger distance to the inner peripheral surface of the cylinder block than the distance from the other-side wall portion to the inner peripheral surface of the cylinder block. Since the cylinder liner has a large volume in the vicinity portion to increase the volume of cooling water in the vicinity portion over the entire circumference in the circumferential direction, the pressure applied to cooling water in the vicinity portion can be dispersed even when the cylinder liner moves in the anti-thrust direction (direction opposite to the thrust direction) for a short time. As a result, it is possible to suppress the increase in flow velocity of cooling water pushed from the vicinity portion. By suppressing the increase in flow velocity of cooling water pushed from the vicinity portion over the entire circumference in the circumferential direction, the cylinder liner can suppress the occurrence of negative pressure area in the cooling water passage, and thus suppress the occurrence of cavitation over the entire circumference in the circumferential direction including the anti-thrust direction.

(3) In some embodiments, in the cylinder liner described in the above (1) or (2), the one-side wall portion has a cooling water passage side surface that faces the cooling water passage. The cooling water passage side surface is formed such that, in at least part in the circumferential direction including the thrust direction of the piston, a distance to the inner peripheral surface of the cylinder block gradually increases with an increase in distance from the seal groove.

According to the above configuration (3), the one-side wall portion of the cylinder liner has the cooling water passage side surface formed such that, in at least part in the circumferential direction including the thrust direction of the piston, a distance to the inner peripheral surface of the cylinder block gradually increases with an increase in distance from the seal groove. In other words, a portion of the cooling water passage contiguous with the portion in the vicinity of the cooling-water-passage-side seal groove has a gradual volume change in at least part in the circumferential direction including the thrust direction of the piston. Since the cylinder liner has a gradual volume change in the portion contiguous with the vicinity portion, cooling water in the vicinity portion can easily flow to the portion contiguous with the vicinity portion when the cylinder liner moves in the thrust direction for a short time. As a result, it is possible to suppress the increase in flow velocity of cooling water pushed from the vicinity portion. By suppressing the increase in flow velocity of cooling water pushed from the vicinity portion, the cylinder liner can suppress the occurrence of negative pressure area in the cooling water passage, and thus suppress the occurrence of cavitation.

(4) In some embodiments, in the cylinder liner described in the above (3), the cooling water passage side surface is formed such that, over the entire circumference in the circumferential direction, a distance to the inner peripheral surface of the cylinder block gradually increases with an increase in distance from the seal groove.

According to the above configuration (4), the one-side wall portion of the cylinder liner has the cooling water passage side surface formed such that, over the entire circumference in the circumferential direction, a distance to the inner peripheral surface of the cylinder block gradually increases with an increase in distance from the seal groove. Since the cylinder liner has a gradual volume change in the portion contiguous with the vicinity portion over the entire circumference in the circumferential direction, cooling water in the vicinity portion can easily flow to the portion contiguous with the vicinity portion even when the cylinder liner moves in the anti-thrust direction (direction opposite to thrust direction) for a short time. As a result, it is possible to suppress the increase in flow velocity of cooling water pushed from the vicinity portion. By suppressing the increase in flow velocity of cooling water pushed from the vicinity portion over the entire circumference in the circumferential direction, the cylinder liner can suppress the occurrence of negative pressure area in the cooling water passage, and thus suppress the occurrence of cavitation over the entire circumference in the circumferential direction including the anti-thrust direction.

(5) In some embodiments, the cylinder liner described in any one of the above (1) to (4) further comprises a seal member mounted on the cooling-water-passage-side seal groove. The seal member includes an O-ring, and a back-up ring disposed closer to the cooling water passage than the O-ring is. The back-up ring is configured to have, in at least part in the circumferential direction including the thrust direction of the piston, a smaller distance to the inner peripheral surface of the cylinder block than a distance from the one-side wall portion to the inner peripheral surface of the cylinder block.

If a distance between the inner peripheral surface of the cylinder block and the one-side wall portion is large, when the cylinder liner is mounted on the cylinder block, the O-ring can easily come out of the cooling-water-passage-side seal groove, which may reduce the workability of the mounting process.

According to the above configuration (5), the back-up ring is disposed closer to the cooling water passage than the O-ring is, and is configured to have, in at least part in the circumferential direction including the thrust direction of the piston, a smaller distance to the inner peripheral surface of the cylinder block than a distance from the one-side wall portion to the inner peripheral surface of the cylinder block. Thus, when the cylinder liner is mounted on the cylinder block, it is possible to prevent the O-ring from coming out of the cooling-water-passage-side seal groove. Thus, the back-up ring can improve the workability of mounting the cylinder liner on the cylinder block.

(6) A cylinder liner according to at least one embodiment of the present invention is a cylinder liner mounted on a cylinder block of an internal combustion engine and slidably accommodating a piston along an axial direction. The cylinder liner comprises: a small diameter portion configured to form a cooling water passage between the small diameter portion and an inner peripheral surface of the cylinder block; a large diameter portion disposed adjacent to the small diameter portion in the axial direction and formed to have a larger diameter than the small diameter portion; and at least one seal groove formed on an outer peripheral surface of the large diameter portion in an annular shape along a circumferential direction. The large diameter portion includes a one-side wall portion formed between the cooling water passage and a cooling-water-passage-side seal groove which is a seal groove disposed closest to the cooling water passage in the axial direction. The one-side wall portion has a cooling water passage side surface that faces the cooling water passage, and the cooling water passage side surface is formed such that, in at least part in a circumferential direction including a thrust direction of the piston, a distance to the inner peripheral surface of the cylinder block gradually increases with an increase in distance from the seal groove.

According to the above configuration (6), the one-side wall portion of the cylinder liner has the cooling water passage side surface formed such that, in at least part in the circumferential direction including the thrust direction of the piston, a distance to the inner peripheral surface of the cylinder block gradually increases with an increase in distance from the seal groove. In other words, a portion of the cooling water passage contiguous with the portion in the vicinity of the cooling-water-passage-side seal groove has a gradual volume change in at least part in the circumferential direction including the thrust direction of the piston. Since the cylinder liner has a gradual volume change in the portion contiguous with the vicinity portion, cooling water in the vicinity portion can easily flow to the portion contiguous with the vicinity portion when the cylinder liner moves in the thrust direction for a short time. As a result, it is possible to suppress the increase in flow velocity of cooling water pushed from the vicinity portion. By suppressing the increase in flow velocity of cooling water pushed from the vicinity portion, the cylinder liner can suppress the occurrence of negative pressure area in the cooling water passage, and thus suppress the occurrence of cavitation.

(7) In some embodiments, in the cylinder liner described in the above (6), the cooling water passage side surface is formed such that, over the entire circumference in the circumferential direction, a distance to the inner peripheral surface of the cylinder block gradually increases with an increase in distance from the seal groove.

According to the above configuration (7), the one-side wall portion of the cylinder liner has the cooling water passage side surface formed such that, over the entire circumference in the circumferential direction, a distance to the inner peripheral surface of the cylinder block gradually increases with an increase in distance from the seal groove. Since the cylinder liner has a gradual volume change in the portion contiguous with the vicinity portion over the entire circumference in the circumferential direction, cooling water in the vicinity portion can easily flow to the portion contiguous with the vicinity portion even when the cylinder liner moves in the anti-thrust direction (direction opposite to thrust direction) for a short time. As a result, it is possible to suppress the increase in flow velocity of cooling water pushed from the vicinity portion. By suppressing the increase in flow velocity of cooling water pushed from the vicinity portion over the entire circumference in the circumferential direction, the cylinder liner can suppress the occurrence of negative pressure area in the cooling water passage, and thus suppress the occurrence of cavitation over the entire circumference in the circumferential direction including the anti-thrust direction.

(8) A sealing structure for a cylinder liner according to at least one embodiment of the present invention is a sealing structure for a cylinder liner mounted on a cylinder block of an internal combustion engine. The sealing structure comprises: the cylinder block; the cylinder liner described in any one of the above (1) to (7); and a seal member mounted on the cooling-water-passage-side seal groove.

According to the above configuration (8), since the sealing structure for a cylinder liner includes the cylinder block, the cylinder liner, and the seal member, when a thrust force of the piston acts on the cylinder liner, the cylinder liner can suppress the increase in flow velocity of cooling water pushed from the vicinity portion, and thus suppress the occurrence of cavitation.

Advantageous Effects

At least one embodiment of the present invention provides a cylinder liner that can suppress the occurrence of cavitation.

DETAILED DESCRIPTION

Figure 1:
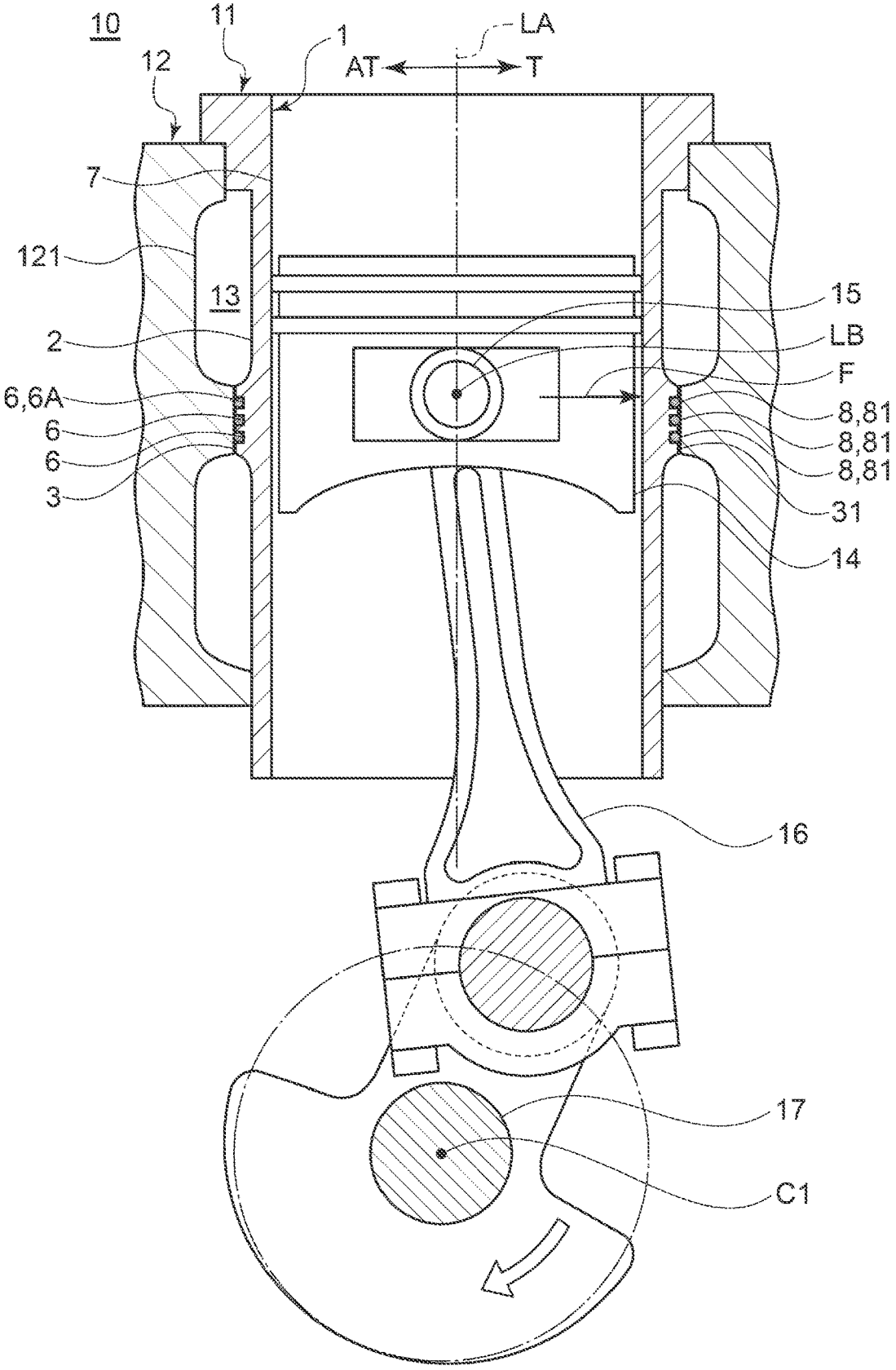
FIG. 1 is a schematic cross-sectional view of an internal combustion engine including a cylinder liner according to an embodiment of the present invention including the axis of the internal combustion engine, and shows the state where the cylinder liner is mounted on a cylinder block.

Embodiments of the present invention will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

The same features can be indicated by the same reference numerals and not described in detail.

FIG. 1 is a schematic cross-sectional view of an internal combustion engine including a cylinder liner according to an embodiment of the present invention, including the axis of the internal combustion engine, and shows the state where the cylinder liner is mounted on a cylinder block.

As shown in FIG. 1, a cylinder liner 1 has a cylindrical shape extending along the direction of the axis LA of the cylinder liner 1, and is mounted on a cylinder block 12 of an internal combustion engine 10. Hereinafter, the direction of the axis LA of the cylinder liner 1 is referred to as "axial direction", and the direction perpendicular to the axial direction is referred to as "radial direction".

As shown in FIG. 1, the internal combustion engine 10 includes the cylinder liner 1, a seal member 8 attached to the cylinder liner 1, the cylinder block 12, a piston 14, a piston pin 15, a connecting rod 16, and a crankshaft 17. A sealing structure 11 for a cylinder liner includes the cylinder liner 1, the seal member 8, and the cylinder block 12.

Each of the cylinder block 12 and the cylinder liner 1 is made of a metal material. The cylinder block 12 has an inner peripheral surface 121 (bore inner peripheral surface) for accommodating the cylinder liner 1. The cylinder liner 1 is disposed inside the inner peripheral surface 121 of the cylinder block 12, and is configured to form a cooling water passage 13 between the cylinder liner 1 and the inner peripheral surface 121 of the cylinder block 12.

The cylinder liner 1 has an inner peripheral surface 7 for accommodating the piston 14 slidably along the axial direction. The piston 14 is disposed inside the inner peripheral surface 7 of the cylinder liner 1, and is connected to one longitudinal end of the connecting rod 16 via the piston pin 15. The other longitudinal end of the connecting rod 16 is connected to the crankshaft 17. The crankshaft 17 is configured to be rotatable around the rotation center C1.

During operation of the internal combustion engine 10, the piston 14 performs a reciprocating motion along the axial direction. The reciprocating motion of the piston 14 is converted to a rotational motion of the crankshaft 17 by the piston pin 15 and the connecting rod 16.

Due to the reciprocating motion of the piston 14 and the rotational motion of the crankshaft 17, the cylinder liner 1 is subjected to a thrust force from the piston 14 toward the outside in the radial direction. The thrust force acts in a direction perpendicular to the axis LA of the cylinder liner 1 and the axis LB of the piston pin 15 (the right-left direction in FIG. 1).

Hereinafter, a side in the direction perpendicular to the axis LA of the cylinder liner 1 and the axis LB of the piston pin 15 and downstream of the rotational direction of the crankshaft 17 at the top dead center (the right side in the figure) is referred to as "thrust side", and a direction toward the thrust side is referred to as "thrust direction T". Further, a side in the direction perpendicular to the axis LA of the cylinder liner 1 and the axis LB of the piston pin 15 and upstream of the rotational direction of the crankshaft 17 at the top dead center (the left side in the figure) is referred to as "anti-thrust side", and a direction toward the anti-thrust side is referred to as "anti-thrust direction AT". In other words, the anti-thrust direction AT is opposite to the thrust direction T.

Figure 2:
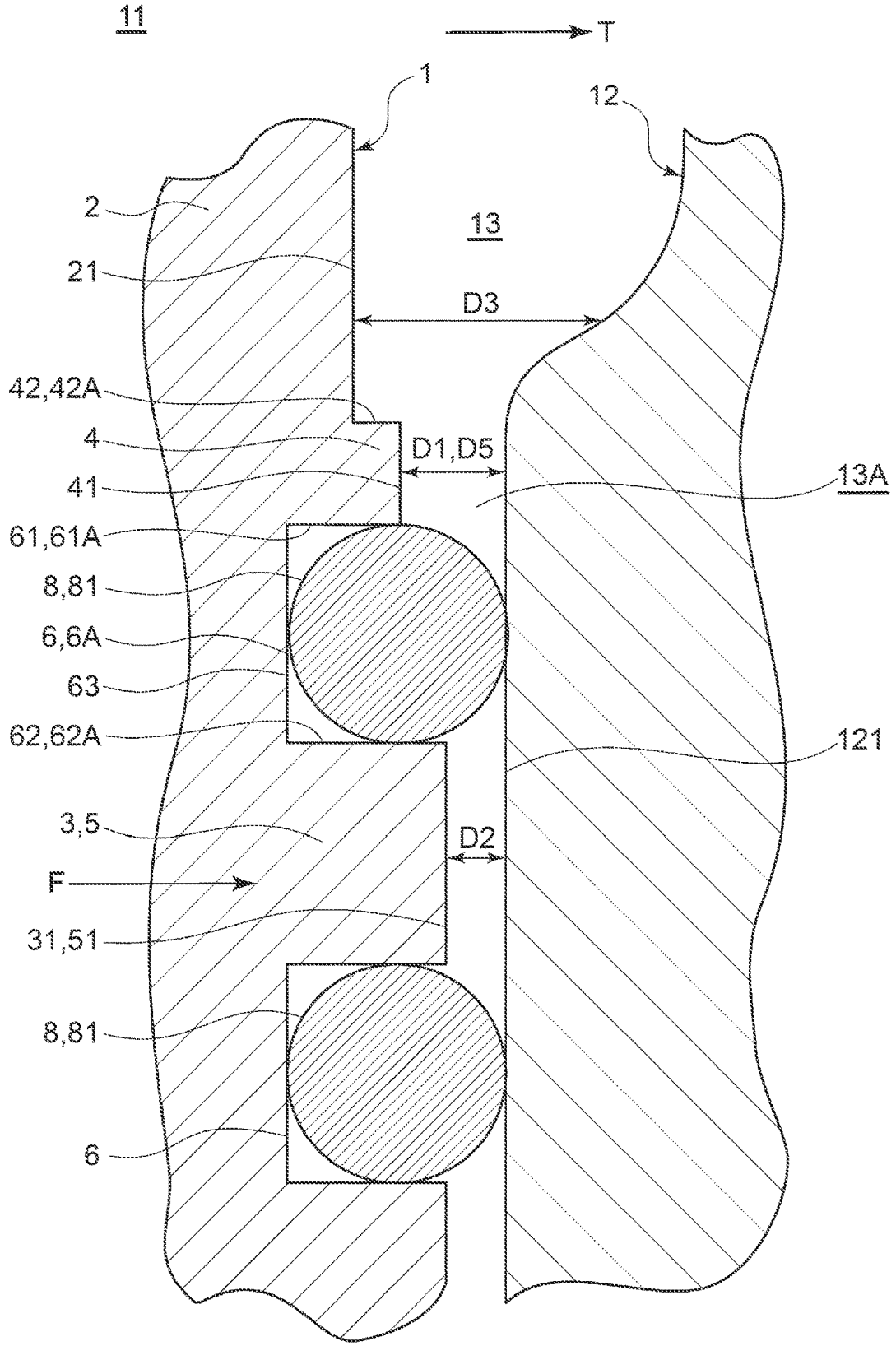
FIG. 2 is a schematic partial enlarged cross-sectional view of a thrust side of the sealing structure of the cylinder liner according to an embodiment of the present invention.
Figure 3:
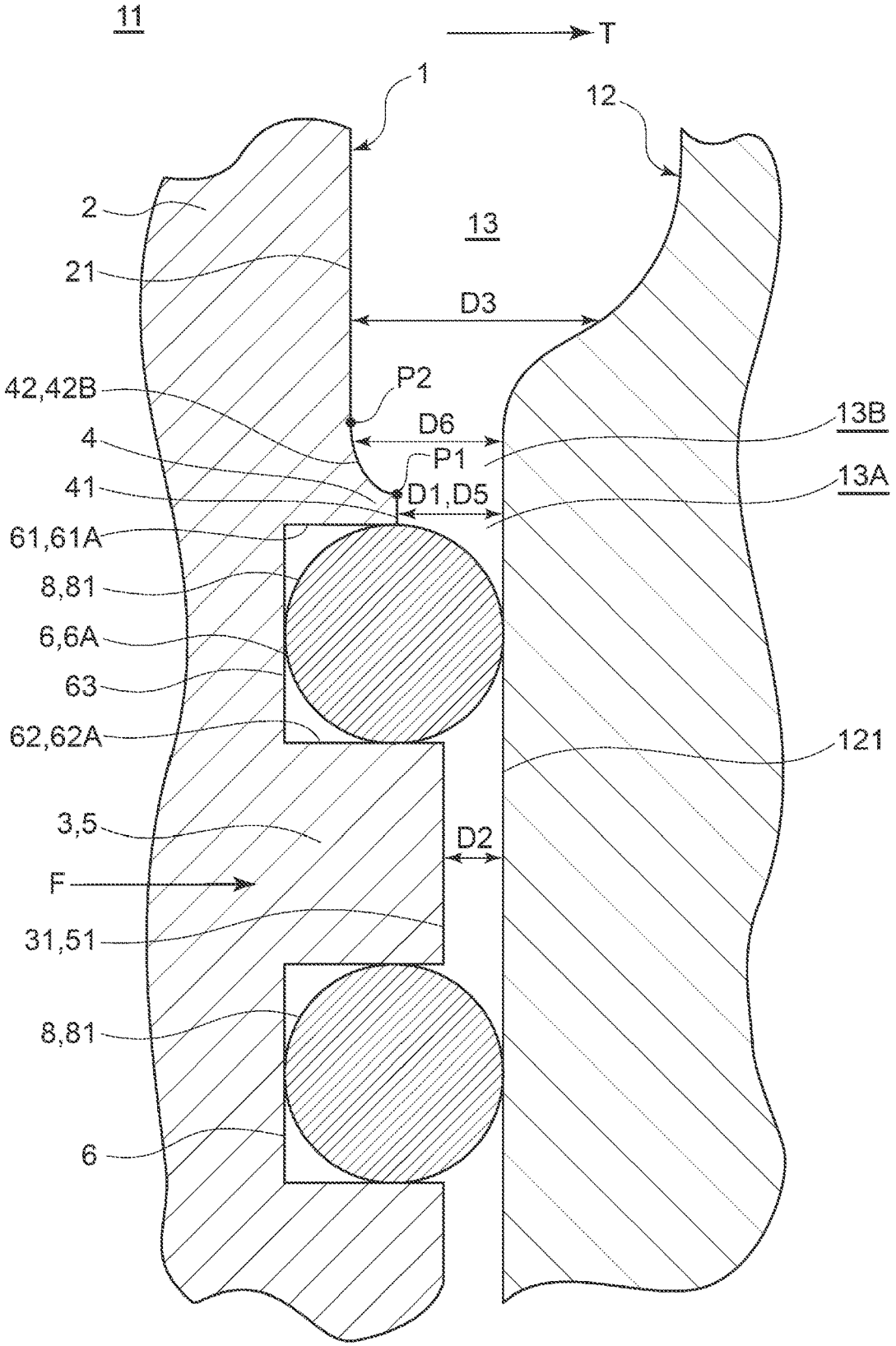
FIG. 3 is a schematic partial enlarged cross-sectional view of a thrust side of the sealing structure of the cylinder liner according to another embodiment of the present invention.
Figure 4:
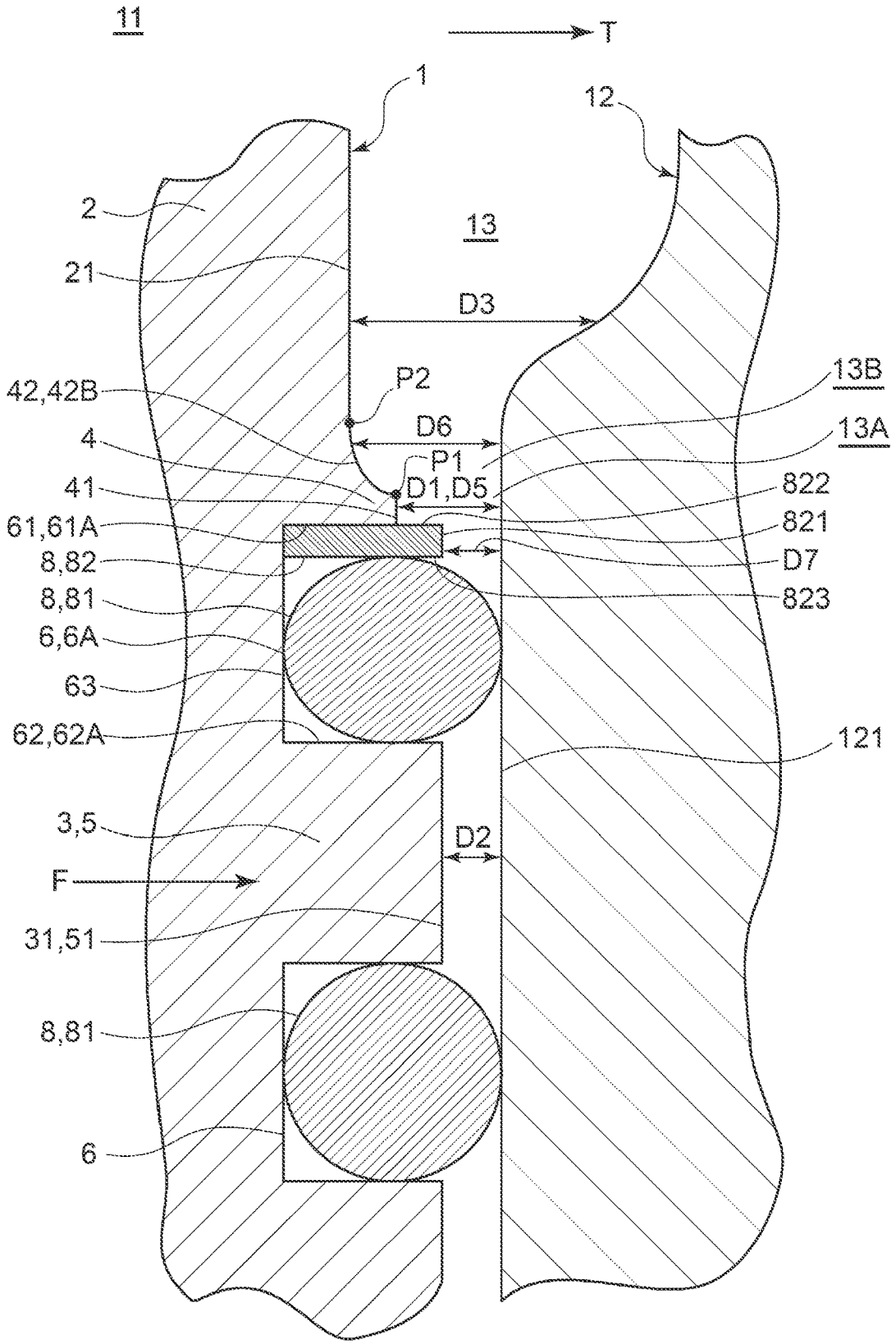
FIG. 4 is a schematic partial enlarged cross-sectional view of a thrust side of the sealing structure of the cylinder liner according to another embodiment of the present invention.

FIG. 2 is a schematic partial enlarged cross-sectional view of the thrust side of the sealing structure of the cylinder liner according to an embodiment of the present invention. FIGS. 3 and 4 are each a schematic partial enlarged cross-sectional view of the thrust side of the sealing structure of the cylinder liner according to another embodiment of the present invention.

As shown in FIG. 1, the cylinder liner 1 includes a small diameter portion 2 configured to form the cooling water passage 13 between the small diameter portion 2 and the inner peripheral surface 121 of the cylinder block 12, a large diameter portion 3 disposed adjacent to the small diameter portion 2 in the axial direction and formed to have a larger diameter than the small diameter portion 2, and at least one seal groove 6 formed on an outer peripheral surface 31 of the large diameter portion 3 in an annular shape along the circumferential direction.

In the illustrated embodiment, the large diameter portion 3 is located at a side closer to the crankshaft 17 than the small diameter portion 2 is in the axial direction (the bottom side in the figure). The at least one seal groove 6 includes three (a plurality of) seal grooves 6 arranged in the axial direction.

In the illustrated embodiment, as shown in FIGS. 2 to 4, the seal groove 6 includes a near passage side surface 61 disposed closest to the cooling water passage 13 in the axial direction (the top side in the figure), a far passage side surface 62 disposed farther away from the cooling water passage 13 than the near passage side surface 61 in the axial direction, and a bottom surface 63 connecting the inner peripheral end of the near passage side surface 61 with the inner peripheral end of the far passage side surface 62. Each of the near passage side surface 61 and the far passage side surface 62 extends along the direction perpendicular to (crossing) the axial direction. The bottom surface 63 extends along the axial direction.

As shown in FIGS. 2 to 4, the seal member 8 is mounted in the seal groove 6. In the illustrated embodiment, the seal member 8 includes an annular O-ring 81 having a circular or elliptical cross-sectional shape. The O-ring 81 is made of an elastic material such as rubber. The O-ring 81 is shrunk along the radial direction and is in contact with the bottom surface 63 and the inner peripheral surface 121 of the cylinder block 12. The O-ring 81 seals the gap between the outer peripheral surface 31 of the large diameter portion 3 and the inner peripheral surface 121 of the cylinder block 12 over the entire circumference in the circumferential direction to prevent cooling water in the cooling water passage 13 from leaking to the crank case side (the bottom side in the figure), which is not shown.

As shown in FIGS. 2 to 4, the large diameter portion 3 includes a one-side wall portion 4 formed between the cooling water passage 13 and a cooling-water-passage-side seal groove 6A which is a seal groove disposed closest to the cooling water passage 13 in the axial direction (the top side in the figure), and an other-side wall portion 5 disposed farther from the cooling water passage 13 than the cooling-water-passage-side seal groove 6A is in the axial direction.

In the illustrated embodiment, the one-side wall portion 4 has a cooling water passage side surface 42 facing the cooling water passage 13, a near passage side surface 61A (61) of the cooling-water-passage-side seal groove 6A, and an outer peripheral surface 41 contiguous with the cooling water passage side surface 42 and the near passage side surface 61A and connecting the outer peripheral end of the cooling water passage side surface 42 and the outer peripheral end of the near passage side surface 61A. The outer peripheral surface 41 of the one-side wall portion 4 extends along the axial direction. The other-side wall portion 5 has a far passage side surface 62A (62) of the cooling-water-passage-side seal groove 6A, and an outer peripheral surface 51 contiguous with the far passage side surface 62A and extending from the outer peripheral end of the far passage side surface 62A along the axial direction in a direction away from the cooling water passage 13.

As shown in FIGS. 2 to 4, the cooling water passage 13 communicates with a cooling water narrow passage 13A.

The cooling water narrow passage 13A is formed between the outer peripheral surface 41 of the one-side wall portion 4 and the inner peripheral surface 121 of the cylinder block 12, and a part of the cooling water narrow passage 13A is delimited by the O-ring 81 inserted in the cooling-water-passage-side seal groove 6A. Hereinafter, the cooling water narrow passage 13A is also referred to as a portion of the cooling water passage 13 in the vicinity of the cooling-water-passage-side seal groove 6A.

As shown in FIGS. 2 to 4, D1 is a distance in the radial direction between the outer peripheral surface 41 of the one-side wall portion 4 and the inner peripheral surface 121 of the cylinder block 12. D2 is a distance in the radial direction between the outer peripheral surface 51 of the other-side wall portion 5 and the inner peripheral surface 121 of the cylinder block 12. D3 is a distance in the radial direction between the outer peripheral surface 21 of the small diameter portion 2 and the inner peripheral surface 121 of the cylinder block 12.

In the illustrated embodiment, as shown in FIGS. 2 to 4, the distance D1 is smaller than the distance D2 at the circumferential position corresponding to the distance D1 over the entire circumference in the circumferential direction.

Figure 5:
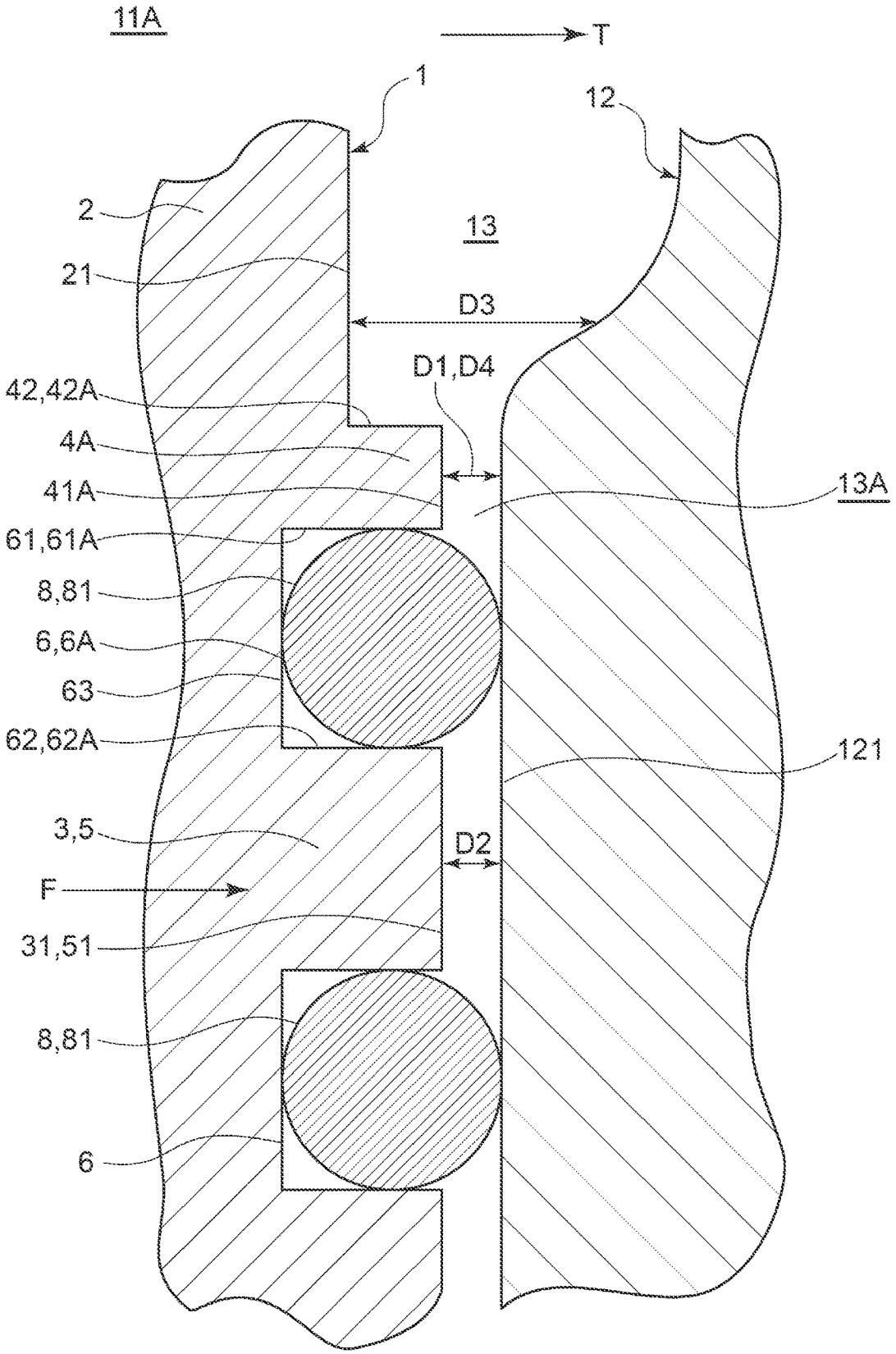
FIG. 5 is a schematic partial enlarged cross-sectional view of a thrust side of the sealing structure of the cylinder liner according to a comparative example.

FIG. 5 is a schematic partial enlarged cross-sectional view of the thrust side of the sealing structure of the cylinder liner according to a comparative example.

As shown in FIG. 5, a one-side wall portion 4A in the sealing structure 11A of the cylinder liner according to the comparative example is configured to have, over the entire circumference in the circumferential direction, the same distance to the inner peripheral surface 121 of the cylinder block 12 as the distance from the other-side wall portion 5 to the inner peripheral surface 121 of the cylinder block 12. In other words, as shown in FIG. 5, the distance D1 (D4) has the same length as the distance D2 at the circumferential position corresponding to the distance D1 over the entire circumference in the circumferential direction.

In the sealing structure 11A of the cylinder liner according to the comparative example, when the thrust force F acts on the cylinder liner 1, the cylinder liner 1 moves in the thrust direction T for a short time. At this time, cooling water in the cooling water narrow passage 13A (the portion of the cooling water passage 13 in the vicinity of the cooling-water-passage-side seal groove 6A) is pushed from the cooling water narrow passage 13A by the pressure applied from the one-side wall portion 4A of the cylinder liner 1, so that the flow velocity is increased. If the difference in flow velocity between cooling water pushed from the cooling water narrow passage 13A into the cooling water passage 13 and cooling water in the cooling water passage 13 is large, a negative pressure area may be generated in the cooling water passage 13. If the negative pressure area is generated in the cooling water passage 13, cavitation is likely to occur in the cooling water passage 13.

The cylinder liner 1 according to some embodiments includes the small diameter portion 2, the large diameter portion 3 including the one-side wall portion 4 and the other-side wall portion 5, and the at least one seal groove 6, as shown in FIGS. 2 to 4. The one-side wall portion 4 is configured to have, in at least part in the circumferential direction including the thrust direction T of the piston 14, a larger distance to the inner peripheral surface 121 of the cylinder block 12 than the distance from the other-side wall portion 5 to the inner peripheral surface 121 of the cylinder block 12. In other words, in at least part in the circumferential direction including the thrust direction T of the piston 14, the distance D1 (D5) is larger than the distance D2 at the circumferential position corresponding to the distance D1.

According to the above configuration, the one-side wall portion 4 of the cylinder liner 1 is configured to have, in at least part in the circumferential direction including the thrust direction T of the piston 14, a larger distance to the inner peripheral surface 121 of the cylinder block 12 than the distance from the other-side wall portion 5 to the inner peripheral surface 121 of the cylinder block 12. In other words, the cooling water narrow passage 13A (the portion of the cooling water passage 13 in the vicinity of the cooling-water-passage-side seal groove 6A) has a large volume in at least part in the circumferential direction including the thrust direction T of the piston 14. Since the cylinder liner 1 has a large volume in the cooling water narrow passage 13A to increase the volume of cooling water in the cooling water narrow passage 13A, the pressure applied to cooling water in the cooling water narrow passage 13A can be dispersed when the cylinder liner 1 moves in the thrust direction T for a short time. As a result, it is possible to suppress the increase in flow velocity of cooling water pushed from the cooling water narrow passage 13A to the cooling water passage 13. By suppressing the increase in flow velocity of cooling water pushed from the cooling water narrow passage 13A, the cylinder liner 1 can suppress the occurrence of negative pressure area in the cooling water passage 13, and thus suppress the occurrence of cavitation.

Figure 6:
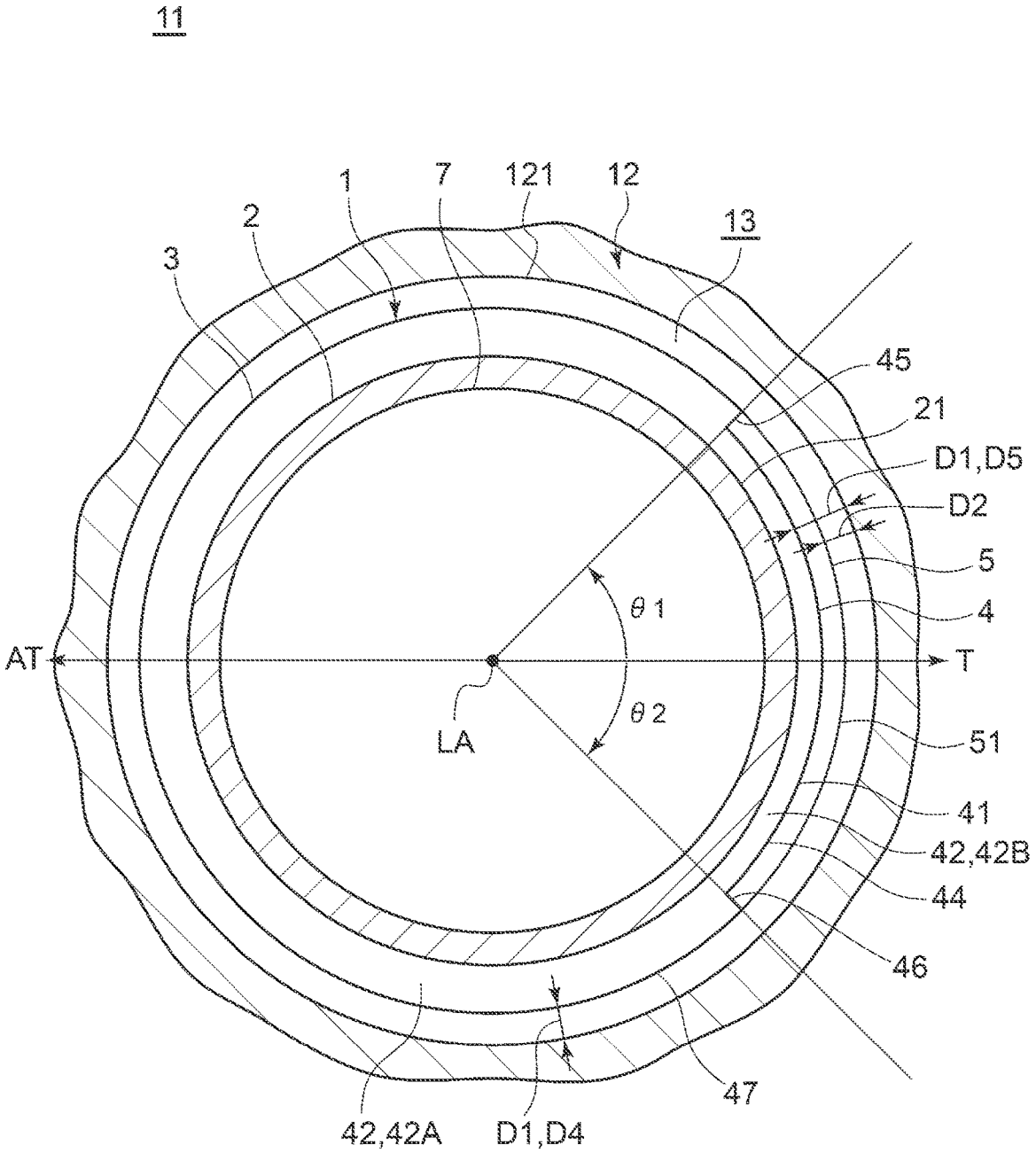
FIG. 6 is a schematic cross-sectional view of the sealing structure of the cylinder liner according to an embodiment of the present invention, perpendicular to the axis of the sealing structure.

FIG. 6 is a schematic cross-sectional view of the sealing structure of the cylinder liner according to an embodiment of the present invention, perpendicular to the axis of the sealing structure.

In some embodiments, as shown in FIG. 6, the one-side wall portion 4 is configured to have, in part in the circumferential direction including the thrust direction T of the piston 14, a larger distance to the inner peripheral surface 121 of the cylinder block 12 than the distance from the other-side wall portion 5 to the inner peripheral surface 121 of the cylinder block 12.

In the illustrated embodiment, as shown in FIG. 6, the one-side wall portion 4 includes a short portion 44 where the outer peripheral surface 41 is disposed radially inward of the outer peripheral surface 51 of the other-side wall portion 5 at the corresponding circumferential position, and a same-diameter portion 47 where the outer peripheral surface 41 overlaps in the radial direction with the outer peripheral surface 51 of the other-side wall portion 5 at the corresponding circumferential position.

In the illustrated embodiment shown in FIG. 6, the short portion 44 is formed continuously along the circumferential direction from a step surface 45, connecting the short portion 44 and the same-diameter portion 47 and formed at a position rotated by a predetermined angle θ1 from the thrust direction T to one side (the counterclockwise direction in the figure) around the axis LA of the cylinder liner 1, to a step surface 46, connecting the short portion 44 and the same-diameter portion 47 and formed at a position rotated by a predetermined angle θ2 from the thrust direction T to the other side (the clockwise direction in the figure) around the axis LA of the cylinder liner 1.

In an embodiment, each of the predetermined angles θ1 and θ2 is equal to or more than 30 degrees. Each of the predetermined angles θ1 and θ2 is preferably equal to or more than 45 degrees, more preferably equal to or more than 60 degrees.

Figure 7:
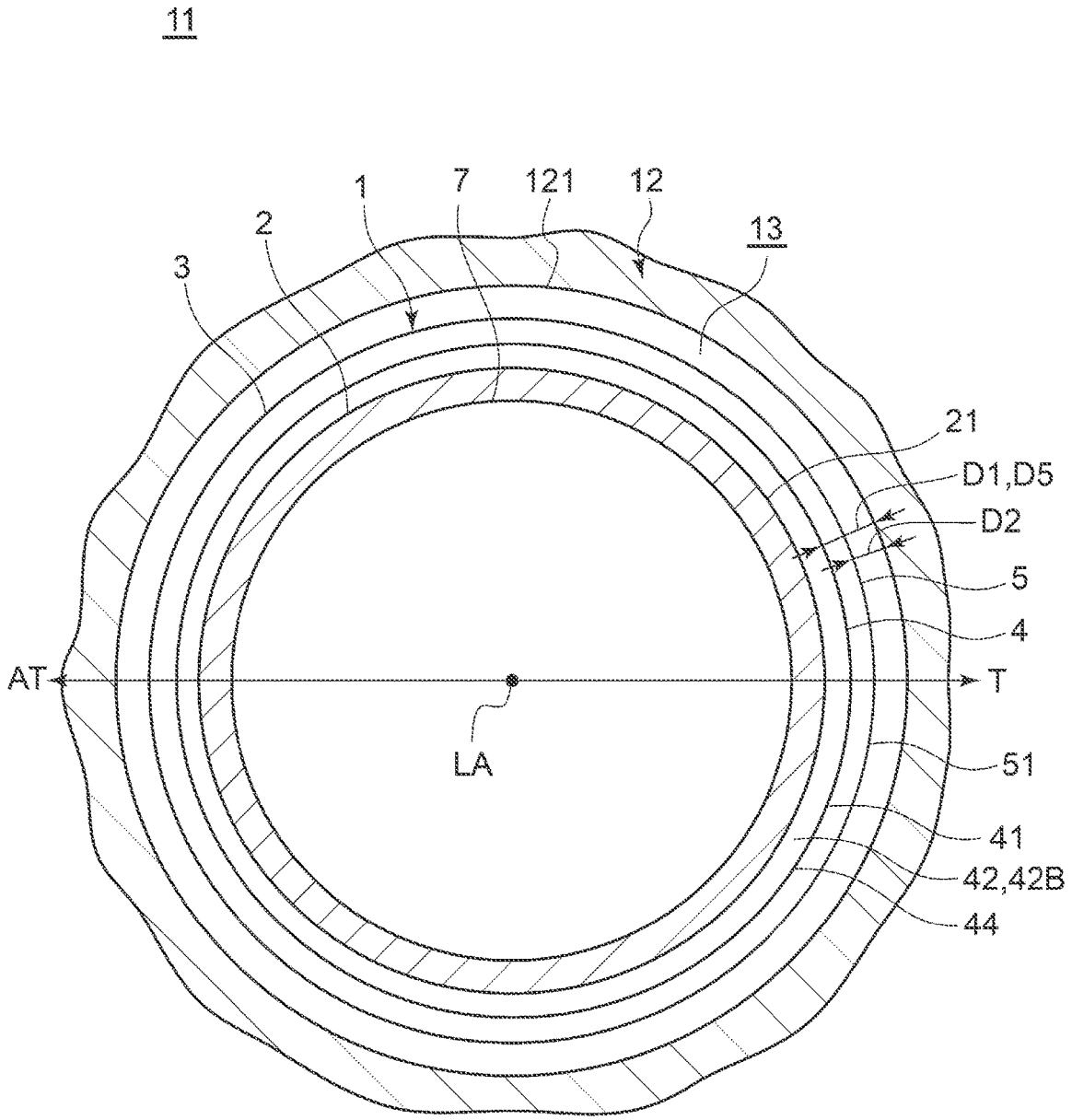
FIG. 7 is a schematic cross-sectional view of the sealing structure of the cylinder liner according to an embodiment of the present invention, perpendicular to the axis of the sealing structure.

FIG. 7 is a schematic cross-sectional view of the sealing structure of the cylinder liner according to an embodiment of the present invention, perpendicular to the axis of the sealing structure.

In some embodiments, as shown in FIG. 7, the one-side wall portion 4 is configured to have, over the entire circumference in the circumferential direction, a larger distance to the inner peripheral surface 121 of the cylinder block 12 than the distance from the other-side wall portion 5 to the inner peripheral surface 121 of the cylinder block 12.

In the illustrated embodiment, as shown in FIG. 7, the one-side wall portion 4 has the short portion 44 over the entire circumference in the circumferential direction including the thrust direction T and the anti-thrust direction AT.

With the above configuration, since the cylinder liner 1 has a large volume in the cooling water narrow passage 13A (the portion of the cooling water passage 13 in the vicinity of the cooling-water-passage-side seal groove 6A) to increase the volume of cooling water in the cooling water narrow passage 13A over the entire circumference in the circumferential direction, the pressure applied to cooling water in the cooling water narrow passage 13A can be dispersed even when the cylinder liner 1 moves in the anti-thrust direction AT (direction opposite to thrust direction T) for a short time. As a result, it is possible to suppress the increase in flow velocity of cooling water pushed from the cooling water narrow passage 13A to the cooling water passage 13. By suppressing the increase in flow velocity of cooling water pushed from the cooling water narrow passage 13A over the entire circumference in the circumferential direction, the cylinder liner 1 can suppress the occurrence of negative pressure area in the cooling water passage 13, and thus suppress the occurrence of cavitation over the entire circumference in the circumferential direction including the anti-thrust direction AT.

Further, with the above configuration, since the cylinder liner 1 has the short portion 44 over the entire circumference in the circumferential direction, the cylinder liner 1 can be mounted on the cylinder block 12 without considering the circumferential position. Thus, with the above-described cylinder liner 1, compared to the case where the short portion 44 is formed partially in the circumferential direction, it is possible to improve the workability of mounting the cylinder liner 1 on the cylinder block 12.

In some embodiments, as shown in FIGS. 3 and 4, the one-side wall portion 4 has the cooling water passage side surface 42 facing the cooling water passage 13. The cooling water passage side surface 42 is formed such that, in at least part in the circumferential direction including the thrust direction T of the piston 14, a distance to the inner peripheral surface 121 of the cylinder block 12 gradually increases with an increase in distance from the seal groove 6. In other words, the cooling water passage side surface 42 includes a cooling water passage side surface 42B formed such that, in at least part in the circumferential direction including the thrust direction T of the piston 14, a distance to the inner peripheral surface 121 of the cylinder block 12 gradually increases with an increase in distance from the seal groove 6.

As shown in FIGS. 3 and 4, one end P1 (the lower end in the figure) of the cooling water passage side surface 42B in the axial direction is connected to an end (the lower end in the figure) of the outer peripheral surface 41 of the one-side wall portion 4 closer to the cooling water passage 13, and the other end P2 (the upper end in the figure) in the axial direction is connected to an end (the lower end in the figure) of the outer peripheral surface 21 of the small diameter portion 2 closer to the seal groove 6.

D6 is a distance in the radial direction between the cooling water passage side surface 42B and the inner peripheral surface 121 of the cylinder block 12. From one end P1 to the other end P2 in the axial direction, the distance D6 gradually increases from the same length as the distance D1 (D5) to the same length as the distance D3.

As shown in FIGS. 3 to 4, between the cooling water passage 13 and the cooling water narrow passage 13A, a cooling water connection passage 13B is formed. The cooling water narrow passage 13A communicates with the cooling water passage 13 via the cooling water connection passage 13B. The cooling water connection passage 13B is formed between the cooling water passage side surface 42B and the inner peripheral surface 121 of the cylinder block 12. Hereinafter, the cooling water connection passage 13B is also referred to as "portion of the cooling water passage 13 contiguous with the portion in the vicinity of the cooling-water-passage-side seal groove 6A".

According to the above configuration, the one-side wall portion 4 of the cylinder liner 1 has the cooling water passage side surface 42 (42B) formed such that, in at least part in the circumferential direction including the thrust direction T of the piston 14, a distance to the inner peripheral surface 121 of the cylinder block 12 gradually increases with an increase in distance from the seal groove 6. In other words, the cooling water connection passage 13B (the portion of the cooling water passage 13 contiguous with the portion in the vicinity of the cooling-water-passage-side seal groove 6A) has a gradual volume change in at least part in the circumferential direction including the thrust direction T of the piston 14. Since the cylinder liner 1 has a gradual volume change in the cooling water connection passage 13B, cooling water in the cooling water narrow passage 13A can easily flow to the cooling water connection passage 13B when the cylinder liner 1 moves in the thrust direction T for a short time. As a result, it is possible to suppress the increase in flow velocity of cooling water pushed from the cooling water narrow passage 13A. By suppressing the increase in flow velocity of cooling water pushed from the cooling water narrow passage 13A, the cylinder liner 1 can suppress the occurrence of negative pressure area in the cooling water passage 13, and thus suppress the occurrence of cavitation.

The present embodiment can be implemented independently, as described below.

In some embodiments, as shown in FIGS. 3 and 4, the cooling water passage side surface 42B is configured to have a curved shape recessed inward in the radial direction. In this case, since the cooling water passage side surface 42B is configured to have a curved shape recessed inward in the radial direction, compared to a virtual inclined plane connecting one end P1 to the other end P2 in a straight line, the volume of the cooling water connection passage 13B can be increased. Since the volume of the cooling water connection passage 13B is increased to increase the volume of cooling water in the cooling water connection passage 13B, cooling water in the cooling water narrow passage 13A can easily flow to the cooling water connection passage 13B when the cylinder liner 1 moves in the thrust direction T for a short time. As a result, it is possible to effectively suppress the increase in flow velocity of cooling water pushed from the cooling water narrow passage 13A.

In some embodiments, as shown in FIG. 6, the cooling water passage side surface 42 is formed such that, in part in the circumferential direction including the thrust direction T of the piston 14, a distance to the inner peripheral surface 121 of the cylinder block 12 gradually increases with an increase in distance from the seal groove 6. In other words, the cooling water passage side surface 42 includes the cooling water passage side surface 42B in part in the circumferential direction including the thrust direction T of the piston 14.

In the illustrated embodiment, as shown in FIG. 6, the cooling water passage side surface 42 includes the cooling water passage side surface 42A (see FIG. 2) extending along the direction perpendicular to (crossing) the axial direction and the cooling water passage side surface 42B.

In the embodiment shown in FIG. 6, the cooling water passage side surface 42B is formed continuously along the circumferential direction from the step surface 45 formed at a position rotated by a predetermined angle θ1 from the thrust direction T to the step surface 46 formed at a position rotated by a predetermined angle θ2 from the thrust direction T.

In some embodiments, as shown in FIG. 7, the cooling water passage side surface 42 is formed such that, over the entire circumference in the circumferential direction, a distance to the inner peripheral surface 121 of the cylinder block 12 gradually increases with an increase in distance from the seal groove 6. In other words, the cooling water passage side surface 42 includes the cooling water passage side surface 42B over the entire circumference in the circumferential direction.

According to the above configuration, the one-side wall portion 4 of the cylinder liner 1 has the cooling water passage side surface 42 (42B) formed such that, over the entire circumference in the circumferential direction, a distance to the inner peripheral surface 121 of the cylinder block 12 gradually increases with an increase in distance from the seal groove 6. Since the cylinder liner 1 has a gradual volume change in the cooling water connection passage 13B (the portion contiguous with the cooling water narrow passage 13A) over the entire circumference in the circumferential direction, cooling water in the cooling water narrow passage 13A can easily flow to the cooling water connection passage 13B even when the cylinder liner 1 moves in the anti-thrust direction AT (direction opposite to thrust direction T) for a short time. As a result, it is possible to suppress the increase in flow velocity of cooling water pushed from the cooling water narrow passage 13A. By suppressing the increase in flow velocity of cooling water pushed from the cooling water narrow passage 13A over the entire circumference in the circumferential direction, the cylinder liner 1 can suppress the occurrence of negative pressure area in the cooling water passage 13, and thus suppress the occurrence of cavitation over the entire circumference in the circumferential direction including the anti-thrust direction AT.

In some embodiments, as shown in FIG. 4, the cylinder liner 1 includes the seal member 8 mounted on the cooling-water-passage-side seal groove 6A. The seal member 8 includes the O-ring 81 and a back-up ring 82 disposed closer to the cooling water passage 13 than the O-ring 81 is. The back-up ring 82 is configured to have, in at least part in the circumferential direction including the thrust direction T of the piston 14, a smaller distance to the inner peripheral surface 121 of the cylinder block 12 than the distance from the one-side wall portion 4 to the inner peripheral surface 121 of the cylinder block 12.

In the illustrated embodiment, the back-up ring 82 is made of a resin material excellent in heat and water resistance and having less elasticity than the O-ring 81. The back-up ring 82 is formed in an arc shape with facing ends in the longitudinal direction of the back-up ring 82. The two ends may extend in the direction perpendicular to the longitudinal direction or may extend in a direction oblique to the longitudinal direction. The back-up ring 82 can be temporarily expanded when it is installed in the cooling-water-passage-side seal groove 6A, which facilitates the installation process in the cooling-water-passage-side seal groove 6A.

As shown in FIG. 4, D7 is a distance in the radial direction between an outer peripheral surface 821 of the back-up ring 82 and the inner peripheral surface 121 of the cylinder block 12.

In the illustrated embodiment, in at least part in the circumferential direction including the thrust direction T of the piston 14, the distance D7 is smaller than the distance D1 (D5). Further, the back-up ring 82 has a surface 822 on one side in the thickness direction in contact with the near passage side surface 61, and a surface 823 on the other side in the thickness direction in contact with the O-ring 81.

If a distance between the inner peripheral surface 121 of the cylinder block 12 and the one-side wall portion 4 is large, the O-ring 81 can easily come out of the cooling-water-passage-side seal groove 6A, which may reduce the workability of the process of mounting the cylinder liner 1 on the cylinder block 12.

According to the above configuration, the back-up ring 82 is disposed closer to the cooling water passage 13 than the O-81 ring is, and is configured to have, in at least part in the circumferential direction including the thrust direction T of the piston 14, a smaller distance to the inner peripheral surface 121 of the cylinder block 12 than a distance from the one-side wall portion 4 to the inner peripheral surface 121 of the cylinder block 12. Thus, when the cylinder liner 1 is mounted on the cylinder block 12, it is possible to prevent the O-ring 81 from coming out of the cooling-water-passage-side seal groove 6A. Thus, the back-up ring 82 can improve the workability of mounting the cylinder liner 1 on the cylinder block 12.

Figure 8:
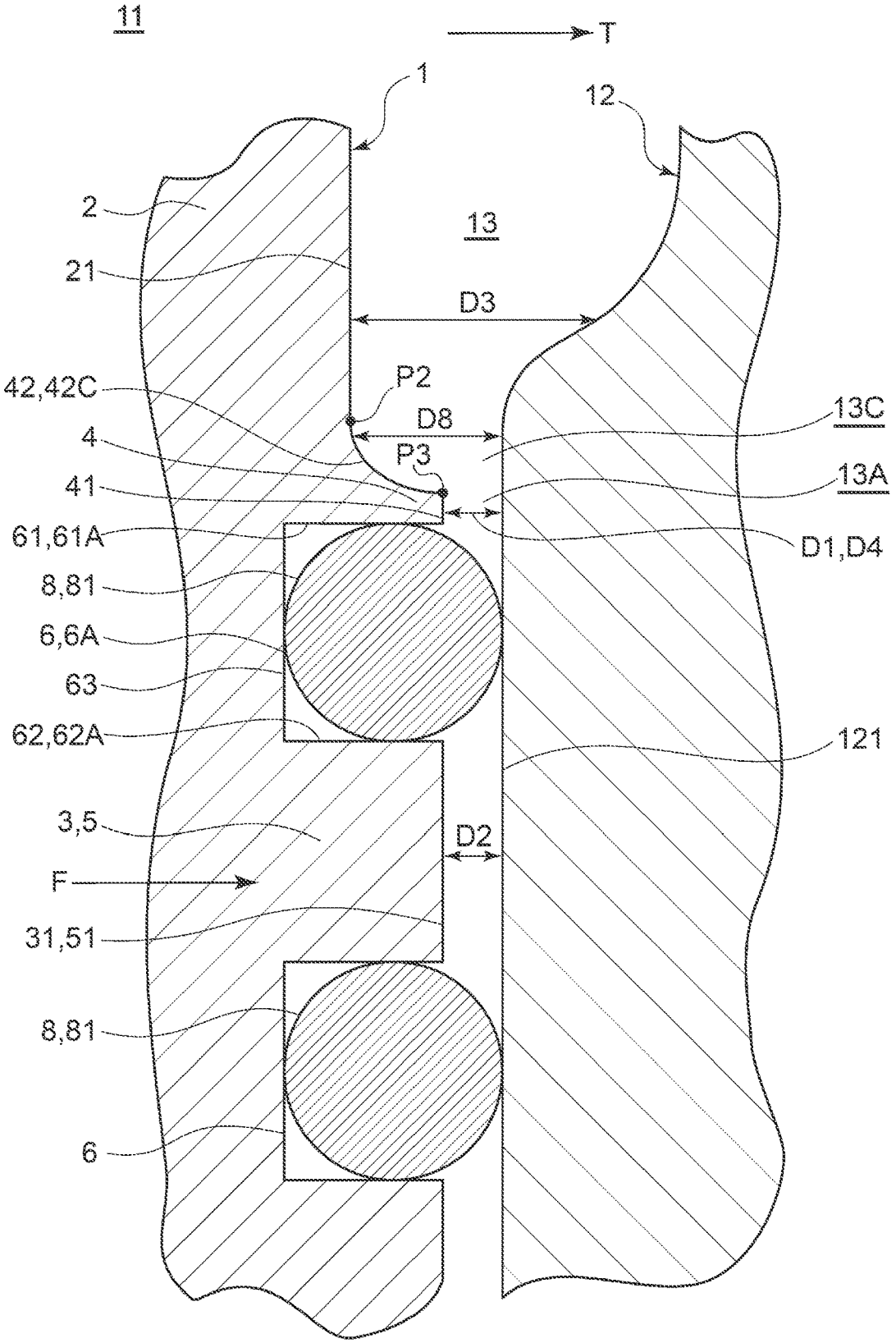
FIG. 8 is a schematic partial enlarged cross-sectional view of a thrust side of the sealing structure of the cylinder liner according to another embodiment of the present invention.

FIG. 8 is a schematic partial enlarged cross-sectional view of the thrust side of the sealing structure of the cylinder liner according to another embodiment of the present invention. The cylinder liner 1 shown in FIG. 8 differs from the cylinder liner 1 shown in FIG. 3 in that the one-side wall portion 4 does not include the short portion 44.

The cylinder liner 1 according to some embodiments includes the small diameter portion 2, the large diameter portion 3 including the one-side wall portion 4, and the at least one seal groove 6, as shown in FIG. 8. The one-side wall portion 4 has a cooling water passage side surface 42 (42C) facing the cooling water passage 13. The cooling water passage side surface 42 (42C) is formed such that, in at least part in the circumferential direction including the thrust direction T of the piston 14, a distance to the inner peripheral surface 121 of the cylinder block 12 gradually increases with an increase in distance from the seal groove 6. In other words, the cooling water passage side surface 42 includes a cooling water passage side surface 42C formed such that, in at least part in the circumferential direction including the thrust direction T of the piston 14, a distance to the inner peripheral surface 121 of the cylinder block 12 gradually increases with an increase in distance from the seal groove 6.

As shown in FIG. 8, one end P3 (the lower end in the figure) of the cooling water passage side surface 42C in the axial direction is connected to an end (the lower end in the figure) of the outer peripheral surface 41 of the one-side wall portion 4 closer to the cooling water passage 13, and the other end P2 (the upper end in the figure) in the axial direction is connected to an end (the lower end in the figure) of the outer peripheral surface 21 of the small diameter portion 2 closer to the seal groove 6.

As shown in FIG. 8, between the cooling water passage 13 and the cooling water narrow passage 13A, a cooling water connection passage 13C is formed. The cooling water narrow passage 13A communicates with the cooling water passage 13 via the cooling water connection passage 13C. The cooling water connection passage 13C is formed between the cooling water passage side surface 42C and the inner peripheral surface 121 of the cylinder block 12. Hereinafter, the cooling water connection passage 13C is also referred to as "portion of the cooling water passage 13 contiguous with the portion in the vicinity of the cooling-water-passage-side seal groove 6A".

In the illustrated embodiment, since the one-side wall portion 4 has the same-diameter portion 47 over the entire circumference in the circumferential direction, the distance D1 (D4) has the same length as the distance D2 at the circumferential position corresponding to the distance D1 over the entire circumference in the circumferential direction. D8 is a distance in the radial direction between the cooling water passage side surface 42C and the inner peripheral surface 121 of the cylinder block 12. From one end P3 to the other end P2 in the axial direction, the distance D8 gradually increases from the same length as the distance D1 (D4) to the same length as the distance D3.

According to the above configuration, the one-side wall portion 4 of the cylinder liner 1 has the cooling water passage side surface 42 (42C) formed such that, in at least part in the circumferential direction including the thrust direction T of the piston 14, a distance to the inner peripheral surface 121 of the cylinder block 12 gradually increases with an increase in distance from the seal groove 6. In other words, the cooling water passage side surface 42C (the portion of the cooling water passage 13 contiguous with the portion in the vicinity of the cooling-water-passage-side seal groove 6A) has a gradual volume change in at least part in the circumferential direction including the thrust direction T of the piston 14. Since the cylinder liner 1 has a gradual volume change in the cooling water passage side surface 42C, cooling water in the cooling water narrow passage 13A can easily flow to the cooling water connection passage 13B when the cylinder liner 1 moves in the thrust direction T for a short time. As a result, it is possible to suppress the increase in flow velocity of cooling water pushed from the cooling water narrow passage 13A. By suppressing the increase in flow velocity of cooling water pushed from the cooling water narrow passage 13A, the cylinder liner 1 can suppress the occurrence of negative pressure area in the cooling water passage 13, and thus suppress the occurrence of cavitation.

In some embodiments, as shown in FIG. 8, the cooling water passage side surface 42C is configured to have a curved shape recessed inward in the radial direction. In this case, since the cooling water passage side surface 42C is configured to have a curved shape recessed inward in the radial direction, compared to a virtual inclined plane connecting one end P3 to the other end P2 in a straight line, the volume of the cooling water connection passage 13C can be increased. Since the volume of the cooling water connection passage 13C is increased to increase the volume of cooling water in the cooling water connection passage 13C, cooling water in the cooling water narrow passage 13A can easily flow to the cooling water connection passage 13C when the cylinder liner 1 moves in the thrust direction T for a short time. As a result, it is possible to effectively suppress the increase in flow velocity of cooling water pushed from the cooling water narrow passage 13A.

In some embodiments, the cooling water passage side surface 42C is formed in part in the circumferential direction including the thrust direction T of the piston 14 as with the cooling water passage side surface 42B. In an embodiment, the cooling water passage side surface 42C is formed continuously along the circumferential direction from a position rotated by a predetermined angle θ1 from the thrust direction T to a position rotated by a predetermined angle θ2 from the thrust direction T, as shown in FIG. 6.

In some embodiments, as shown in FIG. 8, the cooling water passage side surface 42 is formed such that, over the entire circumference in the circumferential direction, a distance to the inner peripheral surface 121 of the cylinder block 12 gradually increases with an increase in distance from the seal groove 6. In other words, the cooling water passage side surface 42 includes the cooling water passage side surface 42C over the entire circumference in the circumferential direction.

According to the above configuration, the one-side wall portion 4 of the cylinder liner 1 has the cooling water passage side surface 42 (42C) formed such that, over the entire circumference in the circumferential direction, a distance to the inner peripheral surface 121 of the cylinder block 12 gradually increases with an increase in distance from the seal groove 6. Since the cylinder liner 1 has a gradual volume change in the cooling water connection passage 13C (the portion contiguous with the cooling water narrow passage 13A) over the entire circumference in the circumferential direction, cooling water in the cooling water narrow passage 13A can easily flow to the cooling water connection passage 13C even when the cylinder liner 1 moves in the anti-thrust direction AT (direction opposite to thrust direction T) for a short time. As a result, it is possible to suppress the increase in flow velocity of cooling water pushed from the cooling water narrow passage 13A. By suppressing the increase in flow velocity of cooling water pushed from the cooling water narrow passage 13A over the entire circumference in the circumferential direction, the cylinder liner 1 can suppress the occurrence of negative pressure area in the cooling water passage 13, and thus suppress the occurrence of cavitation over the entire circumference in the circumferential direction including the anti-thrust direction AT.

The sealing structure 11 for a cylinder liner according to some embodiments includes the cylinder block 12, the cylinder liner 1, and the seal member 8 mounted on the cooling-water-passage-side seal groove 6A described above.

According to the above configuration, since the sealing structure 11 for a cylinder liner includes the cylinder block 12, the cylinder liner 1, and the seal member 8, when a thrust force of the piston 14 acts on the cylinder liner 1, the cylinder liner 1 can suppress the increase in flow velocity of cooling water pushed from the cooling water narrow passage 13A (the portion of the cooling water passage 13 in the vicinity of the cooling-water-passage-side seal groove 6A), and thus suppress the occurrence of cavitation.

The present invention is not limited to the embodiments described above, but includes modifications to the embodiments described above, and embodiments composed of combinations of those embodiments.

REFERENCE SIGNS LIST

1 Cylinder liner
2 Small diameter portion

21 Outer peripheral surface
3 Large diameter portion
31 Outer peripheral surface
4, 4A One-side wall portion
41 Outer peripheral surface
42, 42A to 42C Cooling water passage side surface
44 Short portion
45, 46 Step surface
47 Same-diameter portion
5 Other-side wall portion
51 Outer peripheral surface
6 Seal groove
6A Cooling-water-passage-side seal groove
61, 61A Near passage side surface
62, 62A Far passage side surface
63 Bottom surface
7 Inner peripheral surface
8 Seal member
81 O-ring
82 Back-up ring
821 Outer peripheral surface
10 Internal combustion engine
11 Sealing structure of cylinder liner
11A Sealing structure of cylinder liner according to comparative example
12 Cylinder block
121 Inner peripheral surface
13 Cooling water passage
13A Cooling water narrow passage
13B, 13C Cooling water connection passage
14 Piston
15 Piston pin
16 Connecting rod
17 Crankshaft
AT Anti-thrust direction
C1 Rotation center
D1 to D8 Distance
F Thrust force
LA, LB Axis
T Thrust direction

The invention claimed is:

1. A cylinder liner mounted on a cylinder block of an internal combustion engine and slidably accommodating a piston along an axial direction, the cylinder liner comprising:

a small diameter portion configured to form a cooling water passage between the small diameter portion and an inner peripheral surface of the cylinder block;

a large diameter portion disposed adjacent to the small diameter portion in the axial direction and formed to have a larger diameter than the small diameter portion; and at least one seal groove formed on an outer peripheral surface of the large diameter portion in an annular shape along a circumferential direction, wherein the large diameter portion includes a one-side wall portion formed between the cooling water passage and a cooling-water-passage-side seal groove which is a seal groove disposed closest to the cooling water passage in the axial direction, the one-side wall portion having a first-flat-surface extending in the axial direction, and an other-side wall portion disposed farther from the cooling water passage than the cooling-water-passage-side seal groove is in the axial direction, the other-side wall portion having a second-flat-surface extending in the axial direction, and wherein the first-flat-surface is configured to have, in at least part in a circumferential direction including a thrust direction of the piston, a larger distance to the inner peripheral surface of the cylinder block than a distance from the second-flat-surface to the inner peripheral surface of the cylinder block.

2. The cylinder liner according to claim 1, wherein the one-side wall portion is configured to have, over the entire circumference in the circumferential direction, a larger distance to the inner peripheral surface of the cylinder block than a distance from the other-side wall portion to the inner peripheral surface of the cylinder block.

3. The cylinder liner according to claim 1, wherein the one-side wall portion has a cooling water passage side surface facing the cooling water passage, the cooling water passage side surface being formed such that, in at least part in the circumferential direction including the thrust direction of the piston, a distance to the inner peripheral surface of the cylinder block gradually increases with an increase in distance from the seal groove.

4. The cylinder liner according to claim 3, wherein the cooling water passage side surface is formed such that, over the entire circumference in the circumferential direction, a distance to the inner peripheral surface of the cylinder block gradually increases with an increase in distance from the seal groove.

5. A cylinder liner mounted on a cylinder block of an internal combustion engine and slidably accommodating a piston along an axial direction, the cylinder liner comprising:

a small diameter portion configured to form a cooling water passage between the small diameter portion and an inner peripheral surface of the cylinder block;

a large diameter portion disposed adjacent to the small diameter portion in the axial direction and formed to have a larger diameter than the small diameter portion; and at least one seal groove formed on an outer peripheral surface of the large diameter portion in an annular shape along a circumferential direction, wherein the large diameter portion includes a one-side wall portion formed between the cooling water passage and a cooling-water-passage-side seal groove which is a seal groove disposed closest to the cooling water passage in the axial direction, and an other-side wall portion disposed farther from the cooling water passage than the cooling-water-passage-side seal groove is in the axial direction, wherein the one-side wall portion is configured to have, in at least part in a circumferential direction including a thrust direction of the piston, a larger distance to the inner peripheral surface of the cylinder block than a distance from the other-side wall portion to the inner peripheral surface of the cylinder block, and wherein the seal member includes an O-ring, and a back-up ring disposed closer to the cooling water passage than the O-ring is, the back-up ring being configured to have, in at least part in the circumferential direction including the thrust direction of the piston, a smaller distance to the inner peripheral surface of the cylinder block than a distance from the one-side wall portion to the inner peripheral surface of the cylinder block.

6. A cylinder liner mounted on a cylinder block of an internal combustion engine and slidably accommodating a piston along an axial direction, the cylinder liner comprising:

a small diameter portion configured to form a cooling water passage between the small diameter portion and an inner peripheral surface of the cylinder block;

a large diameter portion disposed adjacent to the small diameter portion in the axial direction and formed to have a larger diameter than the small diameter portion; and at least one seal groove formed on an outer peripheral surface of the large diameter portion in an annular shape along a circumferential direction, wherein the large diameter portion includes a one-side wall portion formed between the cooling water passage and a cooling-water-passage-side seal groove which is a seal groove disposed closest to the cooling water passage in the axial direction, wherein the one-side wall portion has a cooling water passage side surface facing the cooling water passage, the cooling water passage side surface being formed such that, in at least part in a circumferential direction including a thrust direction of the piston, a distance to the inner peripheral surface of the cylinder block gradually increases with an increase in distance from the seal groove, wherein the inner peripheral surface of the cylinder block includes a curved surface configured so that the distance from the cylinder liner to the curved surface decreases toward the seal groove, and wherein the curved surface includes a first-curved-surface which is convex away from the small diameter portion, and a second-curved-surface which is convex toward the small diameter portion, the second-curved-surface being connected to the first-curved-surface via an inflection point, wherein the cooling water passage side surface includes an end in the axial direction, the other end located on an opposite side of the seal groove across the end, and wherein the other end of the cooling water passage side surface is located, in the axial direction, between the seal groove and a middle point of the second-curved-surface.

7. The cylinder liner according to claim 6, wherein the cooling water passage side surface is formed such that, over the entire circumference in the circumferential direction, a distance to the inner peripheral surface of the cylinder block gradually increases with an increase in distance from the seal groove.

8. A sealing structure for a cylinder liner mounted on a cylinder block of an internal combustion engine, the sealing structure comprising:

the cylinder block;

the cylinder liner according to claim 1; and a seal member mounted on the cooling-water-passage-side seal groove.

9. The cylinder liner according to claim 1, wherein a length of the first-flat-surface in the axial direction is shorter than a length of the second-flat-surface in the axial direction.

* * * * *